US006118112A

United States Patent [19]

Osepchuk et al.

[11] Patent Number: 6,118,112

[45] Date of Patent: Sep. 12, 2000

[54] CHOKE KNOB FOR COAXIAL MICROWAVE FEED

[75] Inventors: John M. Osepchuk, Concord, Mass.; Rex E. Fritts, Cedar Rapids, Iowa; Glen R. Breuer, Coralville, Iowa; Thomas L. Miller, Wellman, Iowa

[73] Assignee: Amana Company, L.P., Amana, Iowa

[21] Appl. No.: 09/262,236

[22] Filed: Mar. 4, 1999

[51] Int. Cl.[7] ..... H05B 6/76

[52] U.S. Cl. ..... 219/749; 219/738; 219/756

[58] Field of Search ..... 219/749, 748, 219/738, 741, 756, 754, 751; 174/35 R, 35 GC

[56] References Cited

U.S. PATENT DOCUMENTS

| | | | |
|---|---|---|---|
| 3,480,753 | 11/1969 | Wilson et al. . | |
| 3,805,009 | 4/1974 | Sweet . | |
| 4,053,730 | 10/1977 | Baron et al. | 219/738 |
| 4,303,817 | 12/1981 | Klement et al. | 219/738 |
| 4,429,204 | 1/1984 | Mcguire et al. | 219/738 |
| 4,441,003 | 4/1984 | Eves, II et al. . | |
| 4,764,651 | 8/1988 | Schwartz | 219/751 |
| 4,800,246 | 1/1989 | Lee et al. | 219/738 |

FOREIGN PATENT DOCUMENTS

| | | | |
|---|---|---|---|
| 53-135039 | 11/1978 | Japan | 219/749 |
| 3-70918 | 3/1991 | Japan | 219/749 |

*Primary Examiner*—Philip H. Leung
*Attorney, Agent, or Firm*—Bracewell & Patterson, L.L.P.

[57] ABSTRACT

A microwave apparatus includes a coaxial feed connected to a microwave waveguide and extended into a rotating antenna applicator in a microwave cavity, wherein a gap between the ceiling of the microwave cavity and the top of the rotating antenna applicator as well as between the coaxial feed and the rotating antenna applicator is present to facilitate the rotation of the antenna applicator. The presence of these gaps permit radial leakage, uncontrolled excitation of modes and occasional arcing. An annular knob is provided proximate the coaxial feed and attached to the top of the rotating antenna applicator to suppress radial leakage, uncontrolled excitations and arcing in the microwave cavity.

21 Claims, 3 Drawing Sheets

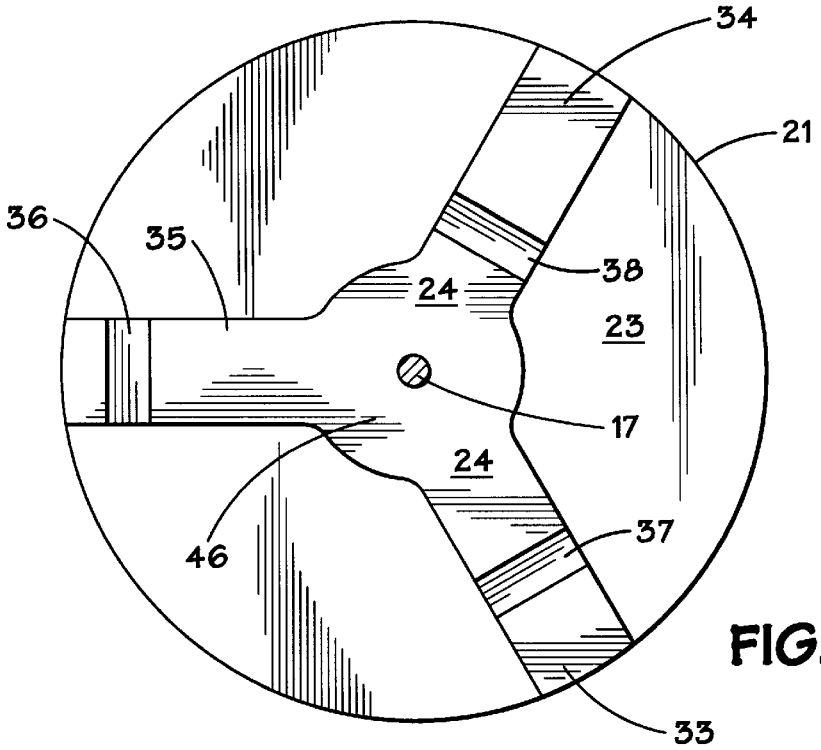
FIG. 4
FIG. 5
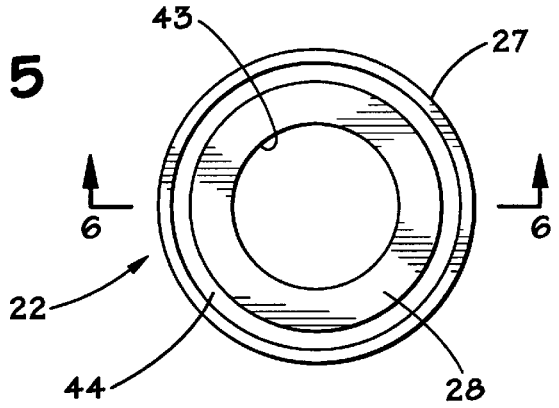
FIG. 6
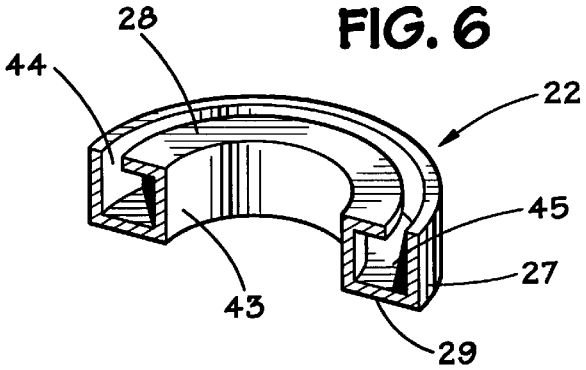

CHOKE KNOB FOR COAXIAL MICROWAVE FEED

BACKGROUND OF THE INVENTION

1. Field of the Invention

Broadly, this invention relates to a microwave apparatus or oven having a cavity and a coaxial feed or transition that extends from an external waveguide to a rotating antenna applicator inside the cavity. In particular, the invention relates to an annular knob that surrounds the coaxial feed and is positioned on the top of the rotating antenna applicator. The annular knob is adapted to suppress the radial leakage, uncontrolled excitations and arcing that occurs within the cavity.

2. Description of Related Art

Microwave cavities may have a coaxial feed or transition from an external waveguide to a rotating antenna applicator inside the microwave cavity. Typically, the coaxial feed is attached to the external waveguide and is disposed through an aperture in the ceiling of the cavity so that it terminates within the rotating antenna applicator. To allow rotation of the antenna applicator, a coaxial gap is provided between the coaxial feed and the rotating antenna applicator and a gap region is provided between the rotating antenna applicator and the ceiling of the microwave cavity. The presence of the coaxial gap permits microwave energy to escape from the antenna applicator (radial leakage). This radial leakage causes uncontrolled excitation of modes and occasional arcing in the gap region between the rotating antenna applicator and the ceiling of the microwave cavity. Accordingly, it is advantageous to suppress the radial leakage from the coaxial gap and suppress the excitations and arcing in the gap region.

Prior attempts have been made to suppress these leaks and excitations by minimizing the coaxial gap and the gap region. Essentially, the correspondence or "fit" between the coaxial feed and the opening in the rotating antenna applicator was adjusted to make the coaxial gap smaller. Likewise, the length of the coaxial feed was reduced so that the gap region between the rotating antenna applicator and the ceiling of the microwave cavity was made smaller. While these attempts partially suppressed the radial leakage and uncontrolled excitations, they caused other problems. First, the smaller coaxial gap and the gap region often caused improper rotation or impeded the rotation of the antenna applicator. Also, a great deal of precision was required, thus causing this solution to be expensive. Still further, with the smaller coaxial gap and the gap region, cleaning became more difficult.

SUMMARY OF INVENTION

Based on the problems as described above, an object of the invention is to provide an apparatus that will adequately suppress radial leakage and the uncontrolled excitations in the coaxial gap and the gap region without decreasing the size of those gaps. An additional object of the invention is to provide an apparatus to affect such suppression that is unobtrusive to the rotation of the antenna applicator. Still further, an object of the invention is to suppress radial leakage and the excitation of modes in a manner that is relatively inexpensive and in such a way that cleaning is not a problem.

As such, in a specific embodiment, the invention is directed to a microwave apparatus having a cavity with side walls, a ceiling, and a waveguide positioned above or below the ceiling of the cavity. The microwave apparatus includes a rotatable antenna applicator or feed structure with a top and bottom, positioned within the microwave cavity. A coaxial transmission conductor, i.e., outer conductor, is connected to the waveguide and extends through the cavity into the rotatable antenna applicator. An inner conductor (inner shaft) is connected at one end to the rotatable antenna applicator through an aperture in the antenna and is operably connected at the other end to a motor positioned outside the waveguide. An annular knob is positioned on the rotatable antenna applicator proximate the outer conductor. The knob substantially fills the gap region between the rotatable antenna applicator and the ceiling of the cavity and suppresses the uncontrolled excitations and any potential arcing in the gap region. The use of this relatively inexpensive knob does not inhibit rotation of the antenna applicator and it does not present a cleaning problem.

In another specific embodiment, the invention relates to a high-powered microwave apparatus having a rectangular cavity with a ceiling, side walls, and a bottom, preferably with the ceiling having a circular opening therein. It is also understood that the "ceiling" could be any wall and is not necessarily limited to the top wall. A substantially rectangular waveguide, with a top and a bottom, is positioned above the rectangular cavity. The waveguide has a circular opening in the top and bottom as well as a transition ramp disposed within the waveguide to reduce the space through which microwave energy is transmitted. The high-powered microwave apparatus also includes a rotatable feed or antenna applicator with a top and bottom, positioned within the microwave cavity. The top of the rotatable feed has a centrally located circular opening. A motor is attached to the top of the waveguide and it is positioned over the opening in the top of the waveguide. An inner cylindrical conductor or shaft is operably connected to the motor. It is disposed through the opening in the top and bottom of the waveguide, the opening in the ceiling of the cavity and the opening in the top of the rotatable feed. The inner cylindrical conductor is connected to the bottom of the rotatable feed. The motor rotates the inner shaft and the attached feed or antenna. An outer cylindrical conductor is connected to the waveguide and disposed through the opening in the ceiling of the cavity and the circular opening in the top of the rotatable feed. An annular knob is disposed around the outer cylindrical conductor and attached to the top of the rotatable feed. The annular knob, substantially filling the gap region between the top of the rotatable feed structure and the ceiling of the cavity and proximate the outer cylindrical conductor, is adapted to suppress the radial microwave leakage from the coaxial gap. The annular knob is also adapted to suppress the uncontrolled excitation and potential arcing that could occur in the gap region between the top of the rotatable feed and the ceiling of the microwave cavity. Again, the ceiling could refer to any of the wall surfaces. Preferably, the annular knob is an enclosure with an annular flat top and bottom and disposed substantially parallel to each other and perpendicular of the top and bottom. The top of the annular knob may have an annular opening or slot. This knob provides an inexpensive way to suppress leakage and uncontrolled excitations. Further, the knob does not inhibit cleaning or the rotation of the antenna applicator.

BRIEF DESCRIPTION OF DRAWINGS

Other objects and advantages of the present invention will become apparent from the following description taken in connection with the accompanying drawings which are set forth by way of illustration and example of one embodiment of the present invention, where:

FIG. 4 is an end view of the Antenna Applicator of FIG. 2 taken along the line 4—4 of FIG. 2;

FIG. 5 is a top view of the Choke Knob; and

FIG. 6 is a perspective, partial cross-sectional view of a coaxial choke knob with a re-entrant cavity taken along line 6—6 of FIG. 5.

Figure 1:
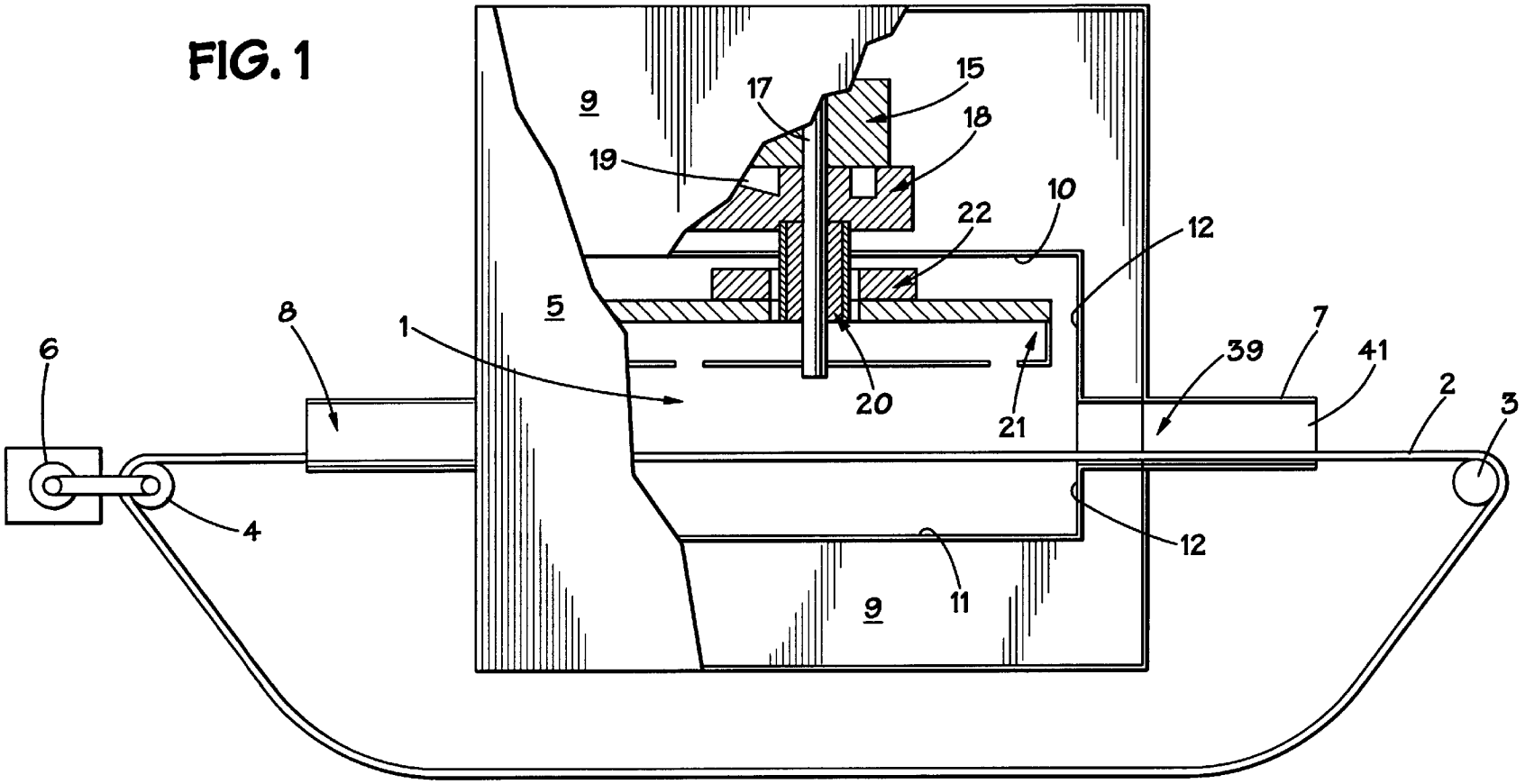
FIG. 1 is a diagrammatical, cross-sectional, side-view of a conveyor-type microwave system embodying the invention.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF SPECIFIC EMBODIMENTS

Specific embodiments of the invention will now be described as part of the detailed description. In the drawings, like elements have the same reference numbers for purposes of simplicity. It is understood that the invention is not limited to the specific examples and embodiments, including those shown in the drawings, which are intended only to assist a person skilled in the art in practicing the invention. Many modifications and improvements may be made without departing from the scope of the invention, which should be determined based on the claims below, including any equivalents thereof.

Within these above descriptions, a more detailed explanation of a specific embodiment follows. Referring to FIG. 1, a conveyor type microwave oven system is shown. The invention described herein is particularly useful in high power (10–100 KW) industrial microwave systems for meat tempering and bacon cooking. However, it should be understood that the invention is not limited to a use in a conveyor type microwave system. The invention may be equally applicable to other types of microwave systems, for example a conventional microwave oven, that uses a coaxial transition or feed from an external waveguide to a rotating antenna applicator inside the microwave cavity. In the conveyor type microwave oven, as shown in FIG. 1, objects to be heated or cooked are positioned on a conveyor belt 2. Conveyor belt 2 is driven in a continuous loop by conveyor motor 6 which is operably connected to a conveyor belt drum or axle 4. The conveyor belt 2 is also disposed over conveyor belt drum or axle 3. Upon activation of conveyor motor 6, conveyor belt 2 passes through a right opening 39 and a left opening (not shown) in the microwave cavity 1 and a right opening 41 and a left opening (not shown) in suppression tunnels 7 and 8, respectively. The suppression tunnels 7 and 8 are attached to the microwave cavity 1 to prevent microwave energy from escaping from the cavity 1.

Still referring to FIG. 1, the cavity 1 is substantially rectangular and formed by an outer microwave enclosure 5, preferably formed of sheets of metal such as stainless steel or aluminum. The cavity 1 is also formed by an inner microwave enclosure 9. This inner microwave enclosure 9 consists of a cavity ceiling 10, a cavity bottom 11, a right cavity side 12, and a left cavity side (not shown. The cavity ceiling 10 contains an aperture therein to facilitate the transmission of microwave energy into the cavity. It is understood that the cavity ceiling may be any of the surfaces of the inner microwave enclosure, including the bottom, right side or left side. Microwave energy is coupled from the microwave energy source (not shown) to the microwave cavity 1 through microwave waveguide 18. The waveguide 18 preferably includes a transition ramp 19 to form a reduced profile waveguide. The transition ramp 19 further directs the microwave energy into a coaxial line formed by inner conductor 17 and outer conductor 20.

The waveguide 18 is positioned above the cavity ceiling 10. An antenna motor housing 15 is positioned above the waveguide and encloses an antenna motor (not shown) used to rotate an antenna applicator 21 within the cavity 1. A coaxial outer conductor 20 is connected to the waveguide 18 and disposed through the aperture in the cavity ceiling 10 so that it associates with the rotating antenna applicator 21. The coaxial feed (formed by inner conductor 17 and outer conductor 20) essentially directs the microwave energy from the waveguide 18 into the antenna applicator 21. An inner conductor shaft 17 is operably and rotatably connected to the antenna motor (not shown), enclosed in the antenna motor housing 15. The other end of the inner shaft 17 is attached to the antenna applicator 21. An annular knob 22 is positioned around the outer conductor 20 and on top of the antenna applicator 21 between the cavity ceiling 10 and the antenna applicator 21.

Figure 2:
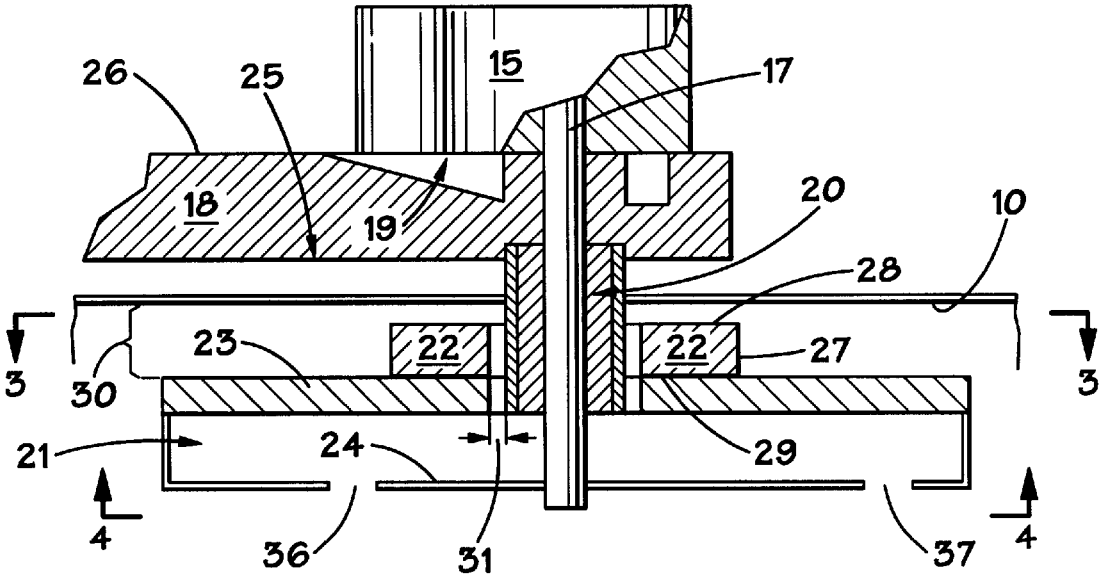
FIG. 2 is a diagrammatical, cross-sectional and enlarged view of a microwave cavity with a coaxial feed embodying the invention.

Referring to FIG. 2, a diagrammatical, cross-sectional and enlarged view of the microwave cavity 1 with a coaxial line feed between conductor 17 and conductor 20 and annular knob 22 embodying the invention is shown. The cavity ceiling 10 is shown having a preferably centrally located aperture therein. A outer conductor 20 is disposed through this aperture to direct and transmit the microwave energy into the microwave cavity 1. Essentially, the microwave energy is transmitted from the microwave energy source (not shown), e.g., a magnetron, through a waveguide 18 into the coaxial line between outer conductor 20 and inner conductor 17, into an antenna applicator 21 and finally into the microwave cavity 1. The outer conductor 20, preferably a cylinder, is attached or connected to the waveguide 18, positioned above the cavity ceiling 10, and is associated with the rotating antenna applicator 21. Preferably, the outer conductor 20 is associated with the antenna applicator 21 by its extension into and loose fit with the centrally located aperture in the antenna applicator 21. The outer conductor 20 may also associate with the antenna applicator 21 by extending up to but not into the antenna applicator 21. The outer conductor 20 may have shapes, or cross-sectional configurations, other than that of a cylinder. The only limitation on the shape of the outer conductor 20 is that it must allow the antenna applicator 21 to smoothly rotate. The waveguide 18, including a bottom 25 and a top 26, directs and transmits the microwave energy from the microwave energy source (not shown) to the coaxial feed between outer conductor 20 and inner conductor 17. The waveguide bottom 25 and the waveguide top 26 each include an aperture (opening) therein. The opening in the waveguide bottom 25 is large enough to tightly accept the outer conductor 20 so that the connection between the feed and the waveguide 18 will permit the transmission of the microwave energy from the waveguide 18 through the coaxial line between outer conductor 20 and inner conductor 17. The connection between the waveguide 18 and the outer conductor 20 may be made by any conventional method in the microwave industry, such as welding. The opening in the waveguide top 26 is large enough to allow an inner shaft 17 to pass through it and rotate without obstruction. The inner shaft 17 is operably connected to the antenna motor (not shown) enclosed in the antenna motor housing 15. The inner shaft 17 is preferably cylindrical, but could also have any other shape that operably connects to a motor so that it rotates and causes the antenna applicator to rotate. The inner shaft 17 is disposed through the cylindrical outer conductor 20 so that it is attached to the rotating antenna applicator 21. The inner shaft 17 and the outer conductor 20 form a coaxial transmission line for directing and transmitting the microwave energy to the antenna applicator 21.

Figure 3:
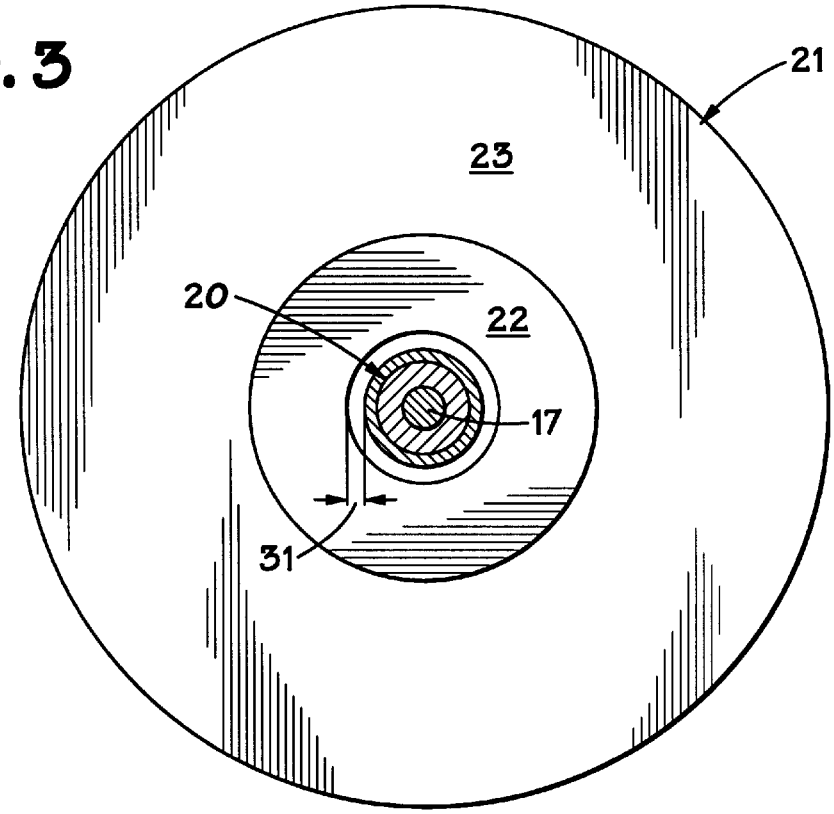
FIG. 3 is a partial cross-sectional view of the Coaxial Feed of FIG. 2 taken along the line 3—3 of FIG. 2.

The antenna applicator 21 includes a top 23 and a bottom 24. The top 23 includes an aperture therein to loosely accept the outer conductor 20. The shape of the aperture depends on the shape of the outer conductor 20. A conductor gap 31 (best shown in FIG. 3) between the cylindrical conductor 20 and the top 23 of the rotating antenna applicator 21 is formed by the loose fit between the outer conductor 20 and the top 23 of the antenna applicator 21. The size of the conductor gap 31 is also dependent on the shape of outer conductor 20 and the aperture in the top 23 of the antenna applicator 21. In any event, the conductor gap 31 is necessary to permit the antenna applicator 21 to rotate when the inner shaft 17 is rotated by the antenna motor. As further shown in FIG. 2, a gap region 30 is formed between the cavity ceiling 10 and the rotating antenna applicator 21 or more specifically, the top 23 of the antenna applicator 21. To partially fill the gap region 30, an annular knob 22 is positioned on the antenna applicator 21. The annular knob 22 suppresses spurious excitation and potential arcing in the gap region 30, as well as the radial leakage from the conductor gap 31. Essentially, the annular knob 22 acts to seal the cavity 1. The annular characteristic of the knob 22 is best depicted in FIG. 3. The annular knob 22 is positioned around the outer conductor 20 and just outside of the conductor gap 31. The annular shape of the knob 22 depends on the shape of the outer conductor 20 and the aperture in the top 23 of the antenna applicator 21. The annular knob 22 is attached to the antenna applicator 21 and thus acts to seal the gap region 30 between the cavity ceiling 10 and the antenna applicator 21. The size and placement of the knob 22 allows for the antenna applicator 21 to be easily cleaned.

Referring to FIG. 4, a view taken along line 4—4 of FIG. 2, a view of the bottom 24 of the antenna applicator 21 is shown. The bottom 24 of the antenna applicator 21 includes a feed structure with a central region 46 and outward radiating feed guides. In a preferred embodiment, the antenna applicator 21 includes three outward radiating feed guides 33, 34 and 35. Each of these legs include a slot opening that allows the microwave energy to pass into the microwave cavity 1. In essence the antenna applicator 21 includes a top 23, i.e., a plate, and a bottom 24 having radial waveguides 33, 34 and 35. The radial waveguides 33, 34 and 35 couples (transmits) the microwave energy from a central region 46 of the antenna applicator 21 radially outwardly to the slots 36, 37 and 38 in the radial waveguides 33, 34 and 35. The antenna motor (not shown) rotates the inner shaft 17 and the connected antenna applicator 21 so that the antenna applicator 21 and the radial waveguides 33, 34 and 35 rotate about the axis of the inner shaft 17 producing a uniform pattern of radiation within the microwave cavity 1.

FIGS. 5 and 6 show a specific embodiment of the annular knob 22. The annular knob 22 includes top 28, outer wall 27, inner wall 43, bottom 29 and an annular opening or gap 44, which opens into annular re-entrant cavity 45. The annular knob 22 is effective in suppressing radial leakage, excitations and arcing even if the opening 44 and re-entrant cavity 45 are eliminated. The knob 22 without the opening 44 is illustrated in FIGS. 2 and 3. The annular top 28 and the annular bottom 29 are preferably disposed parallel to each other and are substantially flat surfaces. The annular inner wall 43 and annular outer wall 27 are preferably disposed substantially parallel to each other and are perpendicular to the top 28 and bottom 29, and are substantially flat surfaces. As shown in FIG. 6, the annular knob 22 can be essentially hollow, and thus the annular opening 44 allows the radial leakage to be captured in the re-entrant cavity 45 of the knob. If the annular opening 44 and the re-entrant cavity 45 are eliminated, the annular knob 22 may be solid while still maintaining comparable suppression results. It is also understood that while the preferred embodiment includes a knob 22 with a substantially flat top, bottom and sides, the knob 22 may include a slanted top, bottom and/or sides. Preferably, the knob 22 is made of a metal, e.g., stainless steel. The knob 22 may also be made of other materials that effectively choke or seal the radial microwave leakage and suppress uncontrolled excitations. Also, as shown in FIGS. 1, 2 and 6, the cross-section of the annular knob 22 is in the shape of a square, it is also recognized that the cross-section of the knob 22 may take on a variety of shapes, for example, rectangular or triangular.

Referring back to FIG. 2, the space between the cavity ceiling 10 and the rotating antenna applicator 21, the gap region 30, is typically 1 inch. Further, the diameter of the rotating antenna applicator 21 is typically two feet. Accordingly, often times resonant modes exist in the gap region 30 which could lead to arcing and potentially worsen the match (VSWR) in the coaxial conductor, especially if the relatively large rotating antenna applicator wobbles. Preferably, the annular knob 22 has a depth of approximately ½–¾ inch, thus reducing the air gap, that is the gap above the annular knob 22 and below the cavity ceiling 10 to approximately ½–¼ inch. Because of this significant reduction in the gap region 30 proximate the outer conductor 20, the radial leakage is reduced and the resonant modes in the gap region 30 are suppressed under the condition that the annular width of the knob is significant and preferably approximately one quarter wavelength. At the same time, the VSWR of the coaxial feed is not disturbed. While these sizes and dimensions are illustrative of a specific embodiment, other sizes and dimensions may also effectively suppress radial leakage and resonant modes.

It is to be understood that the invention is not limited to the exact details of construction, operation, exact materials or embodiments shown and described, as obvious modification and equivalents will be apparent to one skilled in the art. For example, the annular knob 22 may be formed of plastic with a metallic coating or the annular knob 22 may be positioned on the outer edge of the rotating antenna applicator 21. Further, the antenna applicator 21 may be designed to incorporate an annular knob 22 or the knob 22 alternatively could be mounted to the ceiling. Still further, the outer conductor 20 may be designed so that it loosely accepts the knob and still allows for the smooth rotation of the antenna applicator 21. Accordingly, the invention is therefore to be limited only by the scope of the appended claims.

What is claimed is:

1. A microwave apparatus comprising:

a waveguide positioned above a wall of a cavity and having an aperture therein;

a rotatable antenna having a top and a bottom;

an outer conductor connected to the waveguide and associated with the rotatable antenna;

an inner conductor shaft connected at one end to the rotatable antenna through an aperture in the top of the rotatable antenna and connected at the other end to a motor positioned above the waveguide; and an annular knob positioned on the top of the rotatable antenna proximate the outer conductor feed.

2. The apparatus of claim 1 wherein the annular knob is solid having a top, a bottom, and inner wall and an outer wall formed of metal.

3. The apparatus of claim 2 wherein the annular knob is adapted to suppress radial leakage from the conductor gap and suppress excitation in the gap region.

4. The apparatus of claim 2 wherein the inner shaft is disposed within the outer conductor feed, operably connected to the motor and attached to the rotatable antenna to cause the antenna to rotate.

5. The apparatus of claim 1 wherein the annular knob has an annular opening and a re-entrant cavity.

6. The apparatus of claim 5 wherein the annular knob, having a top, a bottom, an inner wall and an outer wall formed of metal.

7. The apparatus of claim 6 wherein the annular knob, having the re-entrant cavity, is adapted to capture radial leakage and suppress excitation in the gap region.

8. A microwave oven, comprising:

a microwave cavity having side-walls, a back wall, a bottom and a ceiling;

a waveguide positioned above the ceiling of the microwave cavity;

a motor housing positioned above the waveguide;

an aperture communicating from the motor housing through the waveguide and the ceiling into the cavity;

an inner shaft operably connected to a motor in the motor housing, wherein the inner shaft extends through the aperture in the waveguide and the ceiling into the cavity;

an antenna applicator having a circular top and a centrally located aperture in the top, wherein the inner shaft is connected to the antenna through the aperture in the circular top;

an outer conductor connected to the waveguide and associated with the aperture in the circular top of the antenna; and an annular knob positioned on top of the rotatable antenna and proximate the outer conductor feed.

9. The apparatus of claim 8 wherein the annular knob is solid having a top, a bottom, and inner wall and an outer wall formed of metal.

10. The apparatus of claim 9 wherein the annular knob is adapted to suppress radial leakage from the conductor gap and suppress excitation in the gap region.

11. The apparatus of claim 8 wherein the annular knob has an annular opening and a re-entrant cavity.

12. The apparatus of claim 11 wherein the annular knob, having a top, a bottom, an inner wall and an outer wall formed of metal.

13. The apparatus of claim 12 wherein the annular knob is adapted to capture radial leakage and suppress excitation in the gap region.

14. A high power microwave apparatus comprising:

a rectangular cavity having a ceiling, side walls, and a bottom, the ceiling having a circular opening therein;

a substantially rectangular waveguide having a top and a bottom, positioned above the ceiling of the cavity, the waveguide having an circular opening in the top and bottom and a transition ramp disposed within the waveguide to reduce the space through which microwave energy is transmitted;

a rotatable antenna having a top and a bottom, the top of the antenna having a centrally located circular opening and the bottom of the antenna having at least one outwardly space slot;

a motor attached to the top of the waveguide and positioned over the opening in the top of the waveguide;

an inner cylindrical shaft connected to the motor, disposed through the opening in the top and bottom of the waveguide and the opening in the top of the antenna, and connected to the antenna;

an outer cylindrical conductor connected to the waveguide connected through the opening in the ceiling of the cavity and associated with the circular opening in the top of the antenna; and an annular knob disposed around the outer cylindrical conductor feed and attached to the top of the rotatable antenna, adapted to suppress the radial microwave leakage from a gap between the circular opening in the top of the rotatable feed and the outer cylindrical conductor.

15. The apparatus of claim 14, wherein the annular knob is an enclosure having an annular top, an annular bottom and annular inner and outer walls, the top having an annular opening.

16. The apparatus of claim 15, wherein the annular top and bottom are disposed substantially parallel to each other and are substantially flat surfaces and the annular inner and outer walls are disposed substantially parallel to each other and substantially perpendicular to the top and bottom.

17. The apparatus of claim 16, wherein the annular knob is adapted to suppress excitation in the gap region.

18. The apparatus of claim 15 wherein the annular knob has an annular opening, and a re-entrant cavity.

19. The apparatus of claim 18 wherein the annular knob, having a top, a bottom, an inner wall and an outer wall formed of metal.

20. The apparatus of claim 19 wherein the annular knob, having the re-entrant cavity, is adapted to capture radial leakage and suppress excitation in the gap region.

21. The apparatus of claim 14, wherein the annular knob is solid having a top, a bottom, an inner wall and an outer wall formed of metal.

* * * * *